US008867964B2

(12) United States Patent
Hashimoto et al.

(10) Patent No.: US 8,867,964 B2
(45) Date of Patent: Oct. 21, 2014

(54) ROTARY BODY UNIT

(71) Applicants: Junichi Hashimoto, Toyohashi (JP); Koji Abe, Nagoya (JP); Masatoshi Shiraki, Nagoya (JP); Yasushi Okabe, Nagoya (JP); Aya Tamura, Tajimi (JP)

(72) Inventors: Junichi Hashimoto, Toyohashi (JP); Koji Abe, Nagoya (JP); Masatoshi Shiraki, Nagoya (JP); Yasushi Okabe, Nagoya (JP); Aya Tamura, Tajimi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 185 days.

(21) Appl. No.: 13/625,386

(22) Filed: Sep. 24, 2012

(65) Prior Publication Data

US 2013/0084103 A1 Apr. 4, 2013

(30) Foreign Application Priority Data

Sep. 30, 2011 (JP) ..... 2011-216399

(51) Int. Cl.

| | |
|---|---|
| ***G03G 15/00*** | (2006.01) |
| ***G03G 21/00*** | (2006.01) |
| ***G03G 21/16*** | (2006.01) |

(52) U.S. Cl.

CPC ..... *G03G 15/5008* (2013.01); *G03G 21/0058* (2013.01); *G03G 21/1647* (2013.01); *G03G 2221/1657* (2013.01)

USPC ..... 399/167; 399/353; 399/357

(58) Field of Classification Search

CPC ..... G03G 15/757; G03G 21/1647; G03G 21/1857; G03G 2221/1657

USPC ..... 399/167, 353, 357

See application file for complete search history.

(56) References Cited

U.S. PATENT DOCUMENTS

| | | | | |
|---|---|---|---|---|
| 6,016,416 | A * | 1/2000 | Kitamura | 399/167 |
| 6,898,399 | B2 * | 5/2005 | Morioka et al. | 399/167 |
| 2009/0169234 | A1 | 7/2009 | Kamimura | |

FOREIGN PATENT DOCUMENTS

| | | |
|---|---|---|
| JP | 2005-234185 | 9/2005 |
| JP | 2008-003444 | 1/2008 |
| JP | 2008-032955 | 2/2008 |
| JP | 2009-162911 | 7/2009 |

* cited by examiner

*Primary Examiner* — William J Royer

(74) *Attorney, Agent, or Firm* — Banner & Witcoff, Ltd.

(57) ABSTRACT

A first rotary body is configured to rotate by a drive force input from an external source and has a first outer peripheral surface. A second rotary body has a second outer peripheral surface and is configured to rotate by following a rotation of the first rotary body through a friction generated between the first outer peripheral surface and the second outer peripheral surface. A first gear is configured to rotate together with the first rotary body. A second gear is configured to rotate together with the second rotary body and is directory engaged with the first gear. The first gear has a first pitch circle and the second gear has a second pitch circle. A radius of the first pitch circle is smaller than a radius of the first rotary body, and a radius of the second pitch circle is larger than a radius of the second rotary body.

10 Claims, 7 Drawing Sheets

ROTARY BODY UNIT

CROSS REFERENCE TO RELATED APPLICATION

This application claims priority from Japanese Patent Application No. 2011-216399 filed Sep. 30, 2011. The entire content of the priority application is incorporated herein by reference.

TECHNICAL FIELD

The disclosure relates to a rotary body unit having a first rotary body driven to rotate by a drive force inputted from an external source, and a second rotary body that follows the rotation of the first rotary body.

BACKGROUND

A rotary body unit including two rotary bodies is known in the art. One example of a conventional rotary body unit includes a photosensitive drum (first rotary body) functioning as a drive roller, and a cleaning roller (second rotary body) functioning as a follow roller that rotates along with the photosensitive drum. The photosensitive drum has a drive-force receiving part for receiving a drive force inputted from an external source, and a first gear provided on the end portion of the drum. The cleaning roller has a second gear engaged with the first gear of the photosensitive drum and rotates along with the photosensitive drum by a drive force transmitted from the first gear.

SUMMARY

When a drive force is transmitted between the first and second gears, the driving torque of the first and second rotary bodies varies in response to changes in the contact point (point of engagement) of the gear teeth caused by manufacturing tolerances of the gear teeth and the like. Since large forces act on the gear teeth of the first and second gears in the conventional configuration of the rotary body unit described above, the drive torque of the first and second rotary bodies can vary greatly, resulting in large fluctuations in the circumferential speeds of the first and second rotary bodies. Accordingly, if the first rotary body is the photosensitive drum, for example, the photosensitive drum can produce lines of density irregularities called "banding" in a toner image transferred onto a paper.

In view of the foregoing, the aspect of the embodiment is to provide a rotary body unit capable of reducing fluctuations in circumferential speeds of the first and second rotary bodies.

In order to attain the above and other objects, there is provided a rotary body unit including a first rotary body, a second rotary body, a first gear, and a second gear. The first rotary body is configured to rotate about a central axis by a drive force input from an external source and has a first outer peripheral surface. The first rotary body has a radius that is a distance from the central axis of the first rotary body to the first outer peripheral surface. The second rotary body has a second outer peripheral surface contacting the first outer peripheral surface of the first rotary body. A friction is generated between the first outer peripheral surface and the second outer peripheral surface when the first rotary body rotates. The second rotary body is configured to rotate about a central axis by following a rotation of the first rotary body through the friction. The second rotary body has a radius that is a distance from the central axis of the second rotary body to the second outer peripheral surface. The first gear is configured to rotate together with the first rotary body. The second gear is configured to rotate together with the second rotary body and is directory meshingly engaged with the first gear. The first gear has a first pitch circle defined by being meshingly engaged with the second gear. The second gear has a second pitch circle defined by being meshingly engaged with the first gear. A radius of the first pitch circle is smaller than the radius of the first rotary body, and a radius of the second pitch circle is larger than the radius of the second rotary body.

DETAILED DESCRIPTION

Next, an embodiment of the present invention will be described while referring to the accompanying drawings. First, the general structure of a color printer 1 serving as an image-forming device will be described. Then, a detailed structure of a process unit 100 as an example of a rotary body unit provided in the color printer 1 will be described.

Directions given in the following description will be based on the reference of a user operating the color printer 1. Specifically, the right side of the color printer 1 in FIG. 1 will be considered the "front," the left side the "rear," the near side the "left side," and the far side the "right side." Additionally, the "top" and "bottom" of the color printer 1 in the following description will be based on the vertical direction in FIG. 1.

General Structure of the Color Printer 1

Figure 1:
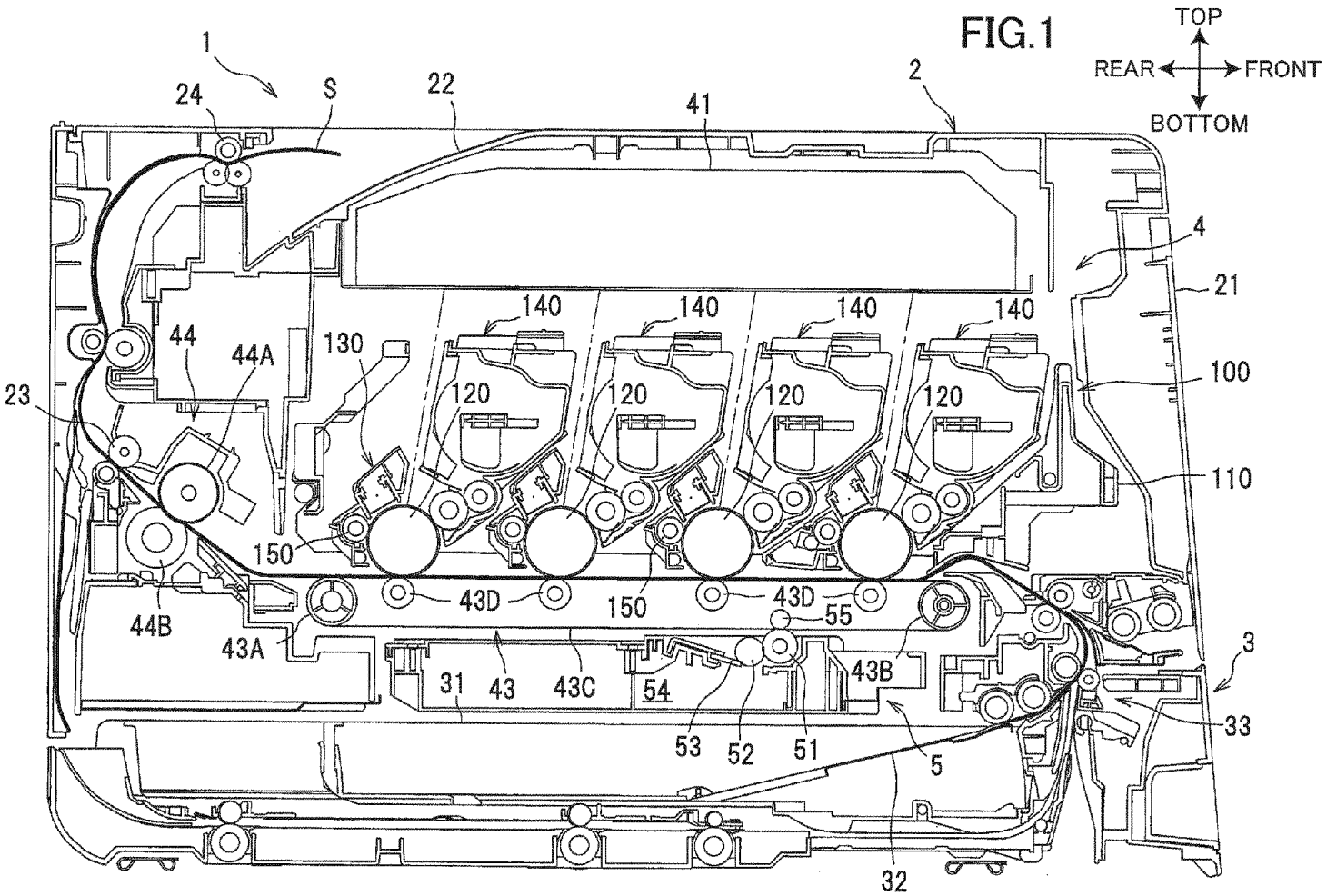
FIG. 1 is a schematic view of a color printer including a rotary body unit according to an embodiment.

As shown in FIG. 1, the color printer 1 includes a main casing 2 and, within the main casing 2, a sheet-feeding unit 3 for supplying sheets S to be printed, an image-forming unit 4 for forming images on the sheet S supplied from the sheet-feeding unit 3, and a cleaning unit 5.

The sheet-feeding unit 3 is provided in the bottom section of the main casing 2 and primarily includes a paper tray 31, a paper-pressing plate 32, and a sheet-feeding mechanism 33. The paper tray 31 accommodates the sheets S of paper. The paper-pressing plate 32 pushes the sheets S accommodated in the paper tray 31 upward toward the sheet-feeding mechanism 33. The sheet-feeding mechanism 33 supplies the sheets S to the image-forming unit 4.

The image-forming unit 4 primarily includes an exposure unit 41, a process unit 100, a transfer unit 43, and a fixing unit 44.

The exposure unit 41 is disposed in the top section of the main casing 2 and includes a laser light source, a polygon mirror, a plurality of lenses, and a plurality of reflecting mirrors (all not shown). The laser light source of the exposure unit 41 emits laser beams based on image data. The laser beams are reflected off the polygon mirror and reflecting mirrors, pass through the lenses, and are scanned over the surfaces of respective photosensitive drums 120 at a high speed (the laser beams are indicated by chain lines in FIG. 1).

The process unit 100 is disposed between the paper tray 31 and exposure unit 41. The process unit 100 primarily includes a drawer 110, photosensitive drums 120 as a first rotary body, chargers 130 as a charging unit, developer cartridges 140, and cleaning rollers 150 as a second rotary body.

The drawer 110 has a general box shape that is open on the top. A front cover 21 provided on the front side of the main casing 2 can be opened, enabling the drawer 110 to be mounted in or removed from the main casing 2 in the front-rear direction (i.e., pushed in or pulled out). Four of the photosensitive drums 120 are arranged parallel to one another in the drawer 110 at intervals in the front-rear direction. Four each of the chargers 130, developer cartridges 140, and cleaning rollers 150 are provided for the corresponding photosensitive drums 120 (some of the reference numerals have been omitted from FIG. 1).

The developer cartridges 140 are detachably mounted in the drawer 110; that is, the developer cartridges 140 are replaceable. Each of the developer cartridges 140 includes a developing roller, a supply roller, a thickness-regulating blade, a toner-accommodating section for holding toner, an agitator, and other components for which reference numerals have not been assigned.

The transfer unit 43 is disposed between the paper tray 31 and the process unit 100 and primarily includes a drive roller 43A, a follow roller 43B, an endless conveying belt 43C stretched taut around the rollers 43A and 43B, and four transfer rollers 431). The outer surface of the conveying belt 43C contacts each of the photosensitive drums 120. The transfer rollers 43D are disposed inside the loop formed by the conveying belt 43C at positions corresponding to the photosensitive drums 120, with the conveying belt 43C interposed therebetween.

The fixing unit 44 is disposed on the rear side of the process unit 100. The fixing unit 44 primarily includes a heating roller 44A, and a pressure roller 44B disposed in confrontation with the heating roller 44A so as to apply pressure to the same.

In the image-forming unit 4, the chargers 130 apply a uniform charge to the surfaces of the corresponding photosensitive drums 120. The exposure unit 41 subsequently exposes the surfaces of the photosensitive drums 120 to laser beams scanned at a high speed, forming electrostatic latent images on the corresponding photosensitive drums 120 based on image data. Next, toner in the developer cartridges 140 is supplied onto the surfaces of the photosensitive drums 120, developing the latent images formed thereon into visible toner images.

In the meantime, a sheet S supplied from the sheet-feeding unit 3 is conveyed between the photosensitive drums 120 and the conveying belt 43C (transfer rollers 43D), at which time the toner images formed on the photosensitive drums 120 are sequentially transferred to and superimposed on the sheet S. The toner images transferred onto the sheet S are subsequently fixed to the sheet S with heat as the sheet S is conveyed between the heating roller 44A and pressure roller 44B.

Thereafter, the sheet S is discharged out of the main casing 2 by conveying rollers 23 and discharge rollers 24 provided in the main casing 2, and is collected in a discharge tray 22.

The cleaning unit 5 is disposed between the paper tray 31 and the transfer unit 43. The cleaning unit 5 primarily includes a belt cleaning roller 51, a recovery roller 52, a scraping blade 53, a reservoir 54, and a backup roller 55.

The color printer 1 executes a cleaning operation after completing an image-forming operation and the like. During this operation, the photosensitive drums 120 and the conveying belt 43C are driven to rotate. As a consequence, toner and the like retained on the cleaning rollers 150 is expelled toward the conveying belt 43C via the photosensitive drums 120 and is collected on the conveying belt 43C. Subsequently, the toner and the like transferred to the conveying belt 43C is collected by the belt cleaning roller 51 and ultimately stored in the reservoir 54.

Detailed Structure of a Rotary Body Unit

Figure 2:
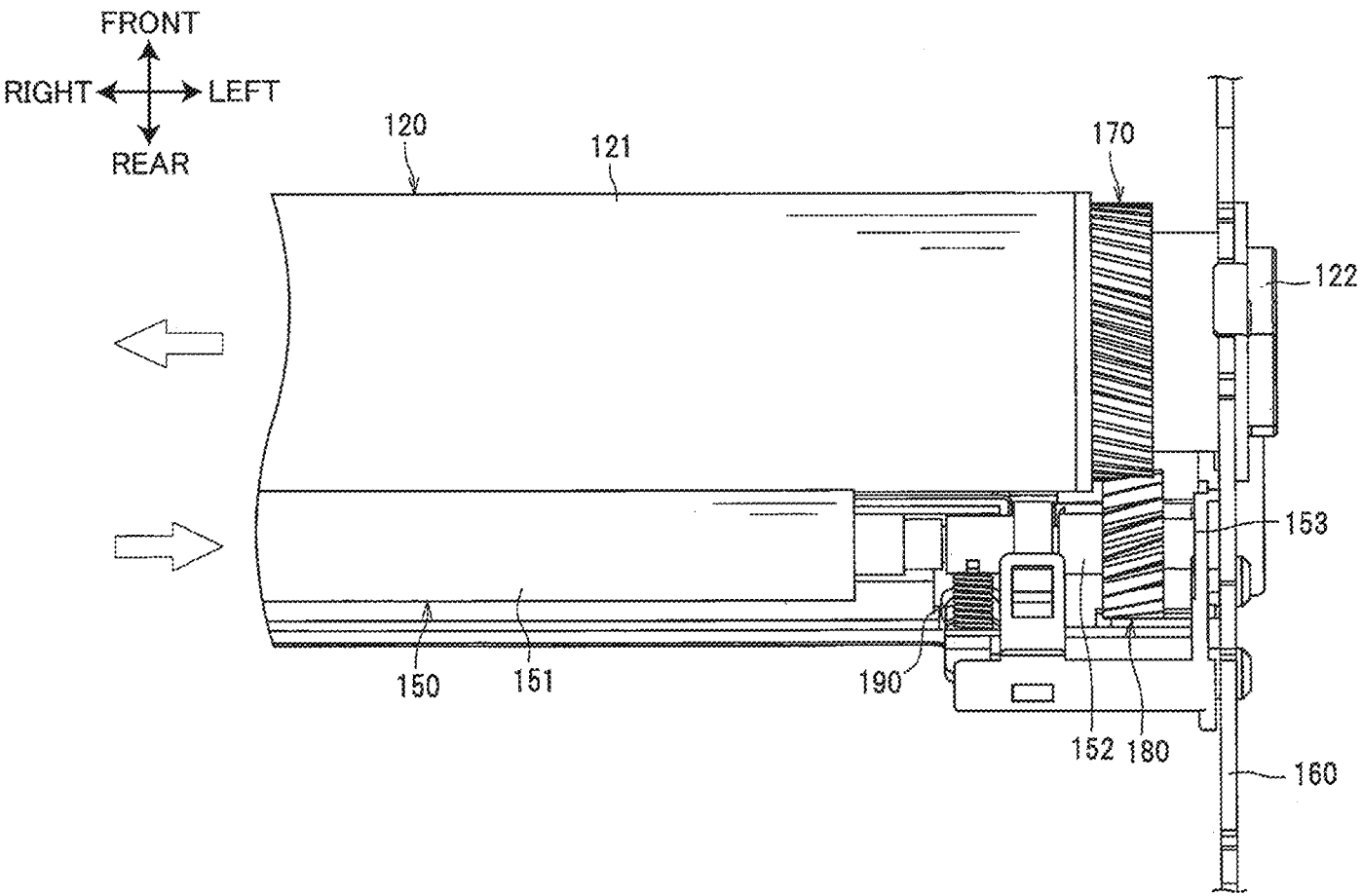
FIG. 2 is a plan view of the rotary body unit according to the embodiment.

Next, the detailed structure of a rotary body unit according to the embodiment will be described. The rotary body unit of the embodiment is the process unit 100. As shown in FIG. 2, in addition to the photosensitive drum 120, charger 130 (see FIG. 5A), and cleaning roller 150, the process unit 100 includes a frame 160 for rotatably supporting the photosensitive drum 120 and cleaning roller 150, a first gear 170, and a second gear 180.

The photosensitive drum 120 is a cylindrical rotary body. An outer peripheral surface 121 of the photosensitive drum 120 is formed of a photosensitive layer that produces an electrostatic latent image when exposed to light. The photosensitive drum 120 is driven to rotate about a central axis by a drive force inputted from an external source (in the main casing 2). Specifically, a coupling 122 is provided on the left end of the photosensitive drum 120, while a drive-force input member (not shown) is provided in the main casing 2 for engaging with the coupling 122. The drive-force input member drives the photosensitive drum 120 to rotate.

In this embodiment, the photosensitive drum 120 is fixed in vertical, left-right, and front-rear positions relative to the main casing 2 in which the frame 160 and process unit 100 are mounted. Accordingly, as will be described later, the photosensitive drum 120 does not move left or right when subjected to a thrust force.

The cleaning roller 150 recovers toner, paper dust, and other matter deposited on the outer peripheral surface 121 of the photosensitive drum 120. In other words, the cleaning roller 150 removes toner, paper dust, and the other matter from the outer peripheral surface 121 of the photosensitive drum 120. The cleaning roller 150 is configured of a metal rotational shaft 152 covered with a roller body formed of an elastic foam material, such as urethane foam. The cleaning roller 150 is disposed so that an outer peripheral surface 151 of the cleaning roller 150 contacts the outer peripheral surface 121 of the photosensitive drum 120. Springs 190 apply a force to the rotational shaft 152 for urging the cleaning roller 150 toward the photosensitive drum 120. With this construction, when the photosensitive drum 120 is driven to rotate, the cleaning roller 150 rotates about a central axis by following the rotation of the photosensitive drum 120 through the friction generated between the outer peripheral surface 121 and outer peripheral surface 151.

In this embodiment, the cleaning roller 150 is rotatably supported in the frame 160. A thrust force described later that is applied to the cleaning roller 150 moves the cleaning roller 150 leftward until a left end 153 of the rotational shaft 152 contacts the frame 160. At this time, the cleaning roller 150 is positioned relative to the frame 160 (the main casing 2).

Figure 3A:
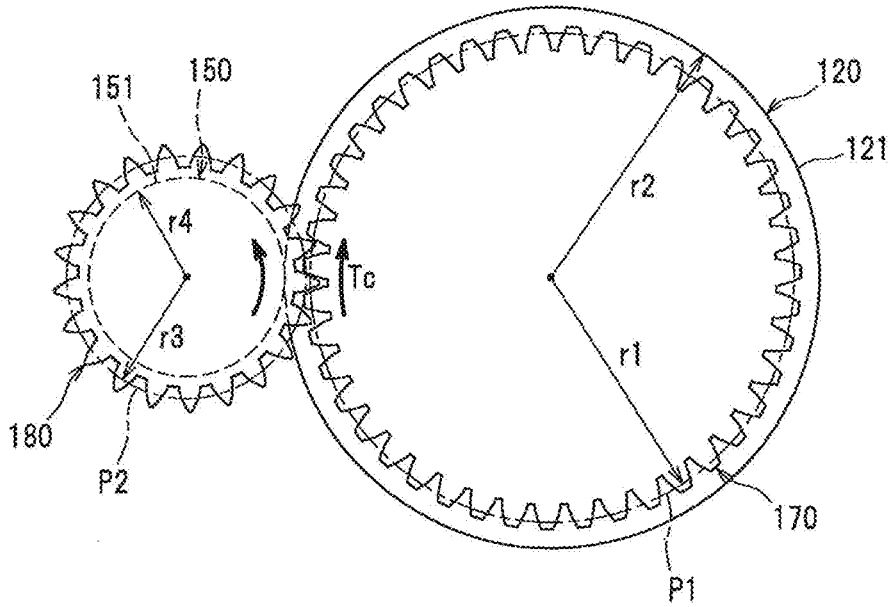
FIG. 3A is a side view of the rotary body unit according to the embodiment.

The first gear 170 is disposed on the left end of the photosensitive drum 120 between the frame 160 and photosensitive drum 120 and is configured to rotate together with the photosensitive drum 120. The first gear 170 is a helical gear. As shown in FIG. 3A, the first gear 170 has a pitch circle P1 with a smaller radius r1 than the radius r2 of the photosensitive drum 120 (i.e., the distance from the center of the photosensitive drum 120 to the outer peripheral surface 121). The pitch circle P1 is an imaginary circle formed by connecting pitch points where each gear tooth of the first gear 170 is in contact with the gear teeth of the second gear 180.

As shown in FIG. 2, the second gear 180 is disposed on the left end of the rotational shaft 152 between the frame 160 and the cleaning roller 150 and is configured to rotate together with the cleaning roller 150. The second gear 180 is also a helical gear and is directly meshingly engaged with the first gear 170. As shown in FIG. 3A, the second gear 180 has a pitch circle P2 with a larger radius r3 than the radius r4 of the cleaning roller 150 (i.e., the distance from the center of the cleaning roller 150 to the outer peripheral surface 151). The pitch circle P2 is an imaginary circle formed by connecting pitch points where each gear tooth of the second gear 180 is in contact with the gear teeth of the first gear 170.

Figure 5A:
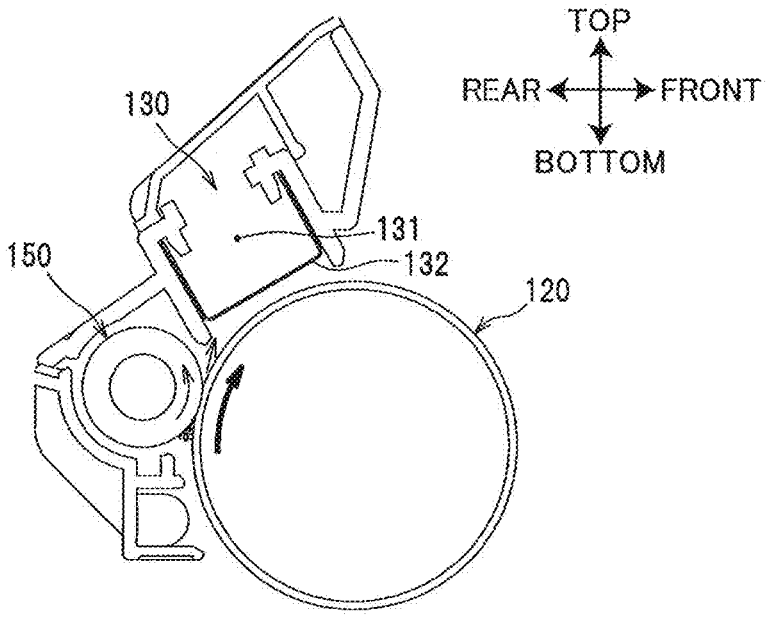
FIG. 5A is an explanatory diagram of effects of the rotary body unit according to the embodiment.

As shown in FIG. 5A, the charger 130 is a scorotron charger having a corona wire 131 that produces a corona discharge when voltage is applied, and a grid 132 for controlling the quantity of charge applied to the photosensitive drum 120. When the process unit 100 is mounted in the main casing 2, the chargers 130 confront the corresponding photosensitive drums 120 from a position diagonally above and rearward of the same. In this embodiment, the chargers 130 are disposed diagonally above and forward of the corresponding cleaning rollers 150 and are adjacent to the cleaning rollers 150 on the downstream side in the direction that the photosensitive drums 120 rotate (the clockwise direction in FIG. 5A).

Operational Advantages of the Rotary Body Unit

The operational advantages of the rotary body unit according to the above embodiment will be described by comparing the rotary body unit of the embodiment to the conventional technology (a rotary body unit of a comparative example).

Figure 4A:
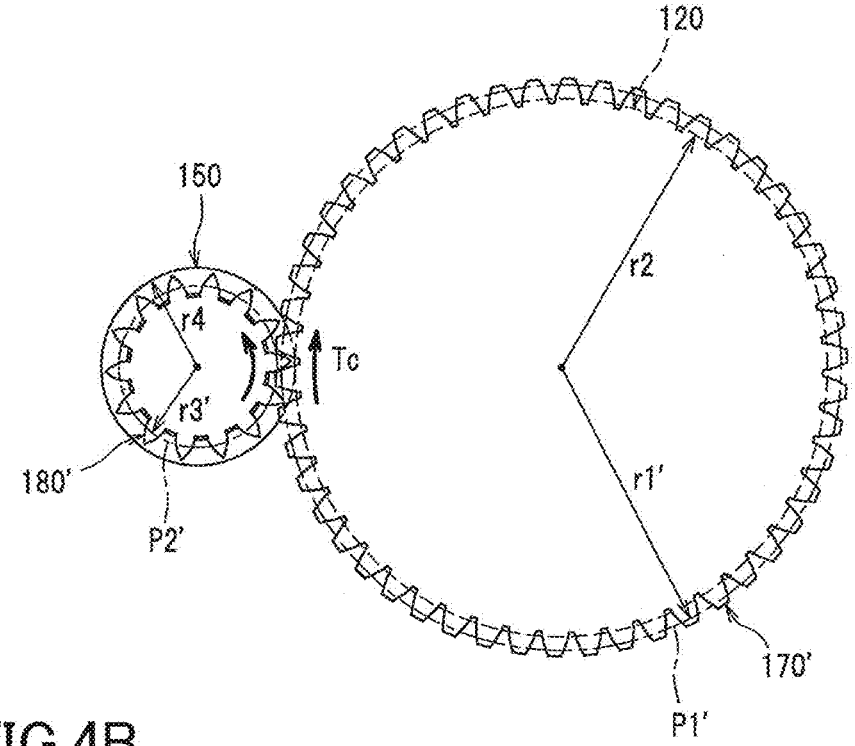
FIG. 4A is a side view of a rotary body unit according to a comparative example.

The structure and operations of the rotary body unit in the comparative example will be described briefly here. As shown in FIG. 4A, the rotary body unit of the comparative example primarily includes the photosensitive drum 120, the cleaning roller 150, a first gear 170', and a second gear 180'.

The first gear 170' is configured to rotate together with the photosensitive drum 120. The first gear 170' has a pitch circle P1' with a larger radius r1' than the radius r2 of the photosensitive drum 120 (i.e., the distance from the center of the photosensitive drum 120 to the outer peripheral surface 121). The second gear 180' is configured to rotate together with the cleaning roller 150. The second gear 180' has a pitch circle P2' with a smaller radius r3' than the radius r4 of the cleaning roller 150 (i.e., the distance from the center of the cleaning roller 150 to the outer peripheral surface 151).

Figure 4B:
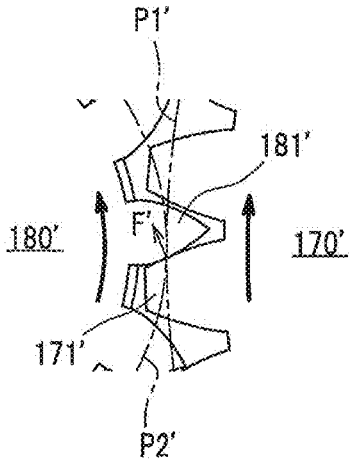
FIG. 4B is an enlarged view showing a contact position between a first gear and a second gear according to the comparative example.

When an external drive force is inputted to the rotary body unit of the comparative example, the photosensitive drum 120 and first gear 170' begin to rotate clockwise in FIG. 4A. As the first gear 170' is driven to rotate, gear teeth 171' formed on the first gear 170' push against the upstream side surface of gear teeth 181 formed on the second gear 180' with respect to the rotating direction of the second gear 180' as shown in FIG. 4B. As a result, the second gear 180' is driven to rotate counterclockwise in FIG. 4B along with the rotation of the cleaning roller 150.

In the rotary body unit of the comparative example, the radius r1' of the pitch circle P1' is greater than the radius r2 of the photosensitive drum 120, and the radius r3' of the pitch circle P2' is smaller than the radius r4 of the cleaning roller 150. Hence, the circumferential speed of the pitch circle P1' is greater than the circumferential speed of the photosensitive drum 120, the circumferential speed of the pitch circle P2' is smaller than the circumferential speed of the cleaning roller 150, and the circumferential speed of the pitch circle P1' is equal to the circumferential speed of the pitch circle P3'. Accordingly, the circumference of the cleaning roller 150 moves at a greater speed than the circumference of the photosensitive drum 120.

On the other hand, as shown in FIG. 3A, when an external drive force is inputted into the rotary body unit of this embodiment, the photosensitive drum 120 and first gear 170 begin rotating clockwise in the drawing. At this time, the circumference of the photosensitive drum 120 moves at a faster speed than the circumference of the first gear 170 (the speed along the pitch circle P1) since the radius r1 of the pitch circle P1 is smaller than the radius r2 of the photosensitive drum 120. Upon rotating the photosensitive drum 120, the friction generated between the outer peripheral surface 121 of the photosensitive drum 120 and the outer peripheral surface 151 of the cleaning roller 150 causes the cleaning roller 150 to rotate counterclockwise in FIG. 3A along with the rotation of the photosensitive drum 120 before gear teeth 171 formed on the first gear 170 press against the upstream side surface of gear teeth 181 formed on the second gear 180 with respect to the rotating direction.

Figure 3B:
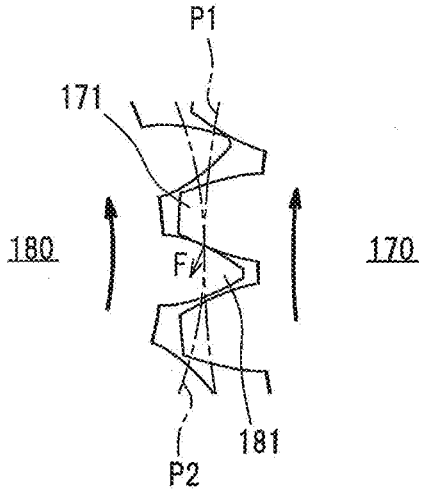
FIG. 3B is an enlarged view showing a contact position between a first gear and a second gear according to the embodiment.

When the cleaning roller 150 initially begins to rotate, that is, before the gear teeth 171 contact (engage with) the gear teeth 181 within the range of play between the first gear 170 and second gear 180, the cleaning roller 150 attempts to rotate at the same speed as the photosensitive drum 120. However, since the radius r1 of the pitch circle P1 is smaller than the radius r2 of the photosensitive drum 120 and the radius r3 of the pitch circle P2 is greater than the radius r4 of the cleaning roller 150, the circumferential speed of the second gear 180 (speed along the pitch circle P2) is greater than the circumferential speed of the first gear 170. Consequently, as illustrated in FIG. 3B, the gear teeth 181 of the second gear 180 catch up to the gear teeth 171 of the first gear 170 and contact the upstream side surface of the gear teeth 171 with respect to the rotating direction.

This contact applies a braking effect to the second gear 180 and to the cleaning roller 150 that rotates together with the second gear 180. At this time, the second gear 180 attempts to rotate at the same speed as the first gear 170 at this time. Then, the circumferential speed of the cleaning roller 150 having the radius r4 smaller than the radius r3 of the pitch circle P2 becomes slower than the circumferential speed of the second gear 180, and the circumferential speed of the photosensitive drum 120 having the radius r2 greater than the radius r1 of the pitch circle P1 becomes faster than the circumferential speed of the first gear 170. Hence, in the rotary body unit of this embodiment, the circumferential speed of the cleaning roller 150 becomes slower than the circumferential speed of the photosensitive drum 120.

If F is the force applied to the gear teeth 171 and 181 of the first and second gears 170 and 180, F' is the force applied to the gear teeth 171' and 181' of the first and second gears 170' and 180', and $\mu N_0$ is the frictional force between the photosensitive drum 120 and cleaning roller 150, then an external load Tc applied to the rotational shaft 152 of the cleaning roller 150 by bearings supporting the rotational shaft 152 and the like can be calculated from Equation (1) below for the rotary body unit of this embodiment and from Equation (2) below for the rotary body unit of the comparative example (where F, F', $\mu N_0$, and Tc are all positive values).

$$Tc=-F\cdot r3+\mu N_0\cdot r4 \quad (1)$$

$$Tc=F'\cdot r3'-\mu N_0\cdot r4 \quad (2)$$

From Equations (1) and (2) above, it is possible to find the force F applied to the gear teeth 171 and 181 using Equation 3 below and the force F' applied to the gear teeth 171' and 181' using Equation 4 below.

$$F=(\mu N_0\cdot r4-Tc)/r3 \quad (3)$$

$$F'=(\mu N_0\cdot r4+Tc)/r3' \quad (4)$$

Since ($\mu N_0\cdot$r4−Tc) in Equation (3) is smaller than ($\mu N_0\cdot$r4−Tc) in Equation (4) and the radius r3 is greater than the radius r3', the force F applied to the gear teeth 171 and 181 in the rotary body unit of this embodiment is clearly smaller than the force F' applied to the gear teeth 171' and 181' in the rotary body unit of the comparative example.

Hence, the structure of this embodiment can reduce fluctuations in the drive torque of the photosensitive drum 120 and cleaning roller 150, even if the contact point (point of engagement) of the gear teeth 171 and 181 fluctuates along the radial direction of the pitch circles P1 and P2. Since this in turn reduces fluctuations in the circumferential speeds of the photosensitive drum 120 and cleaning roller 150, the structure of this embodiment can markedly reduce banding and other artifacts caused by fluctuations in the circumferential speed of the photosensitive drum 120.

Further, since the circumferential speed of the cleaning roller 150 becomes slower than the circumferential speed of the photosensitive drum 120, the cleaning roller 150 can apply a force to the outer peripheral surface 121 of the photosensitive drum 120 in the direction opposite the rotating direction of the photosensitive drum 120. As a result, the cleaning roller 150 can effectively recover (scrape off) toner and other matter deposited on the outer peripheral surface of the photosensitive drum 120, thereby improving the cleaning property of the cleaning roller 150.

Forming the roller body of the cleaning roller 150 of an elastic foam material is a particular advantage of this embodiment. The porous (irregularity) surface of the elastic foam material can more reliably scrape toner and other matter from the photosensitive drum 120, thereby further improving the cleaning capacity of the cleaning roller 150.

In addition, a stable cleaning performance can be ensured since the structure of this embodiment can reduce fluctuations in the circumferential speed of the cleaning roller 150, as described above.

Since both the first and second gears 170 and 180 are helical gears, a rightward thrust is applied to the photosensitive drum 120 in this embodiment, while a leftward thrust is applied to the cleaning roller 150, as indicated by arrows in FIG. 2. However, these thrust forces can be reduced in the structure of this embodiment because the force applied to the gear teeth 171 and 181 is smaller than that applied to the gear teeth 171' and 181' in the comparative example.

Since this configuration makes it possible to avoid an unnecessarily large force applied to the photosensitive drum 120, which is positioned relative to the frame 160, a decline in positioning precision for the photosensitive drum 120 can be avoided. On the other hand, while small, the thrust force applied to the cleaning roller 150 can move the cleaning roller 150 leftward so that the left end 153 of the rotational shaft 152 contacts the frame 160, thereby positioning the cleaning roller 150 relative to the frame 160.

Further, reducing the thrust forces on the photosensitive drum 120 and cleaning roller 150 reduces the resistance to their rotation, enabling the photosensitive drum 120 and cleaning roller 150 to rotate smoothly. Smaller thrust forces also ensure that an unnecessarily large force is not applied to the photosensitive drum 120 and cleaning roller 150. This configuration can reduce wear on the photosensitive drum 120 and cleaning roller 150, improving the durability (life) of the same.

Figure 5B:
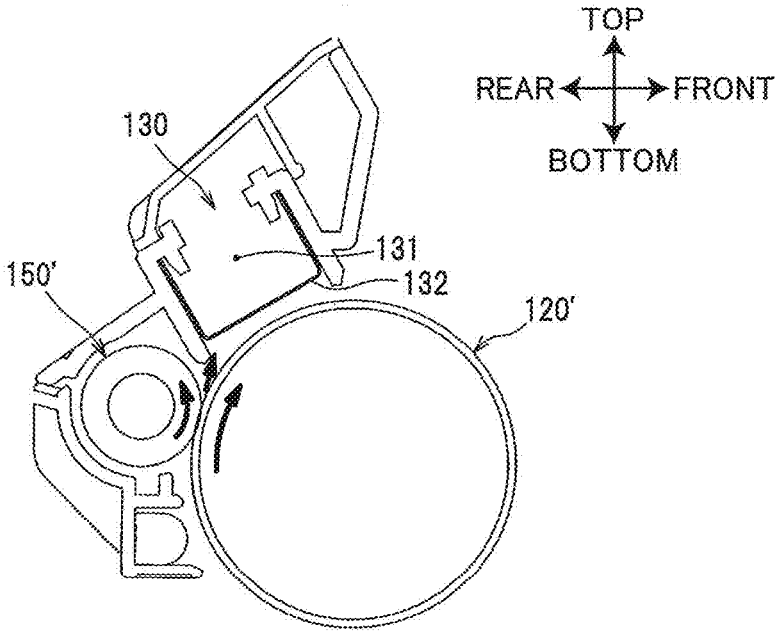
FIG. 5B is an explanatory diagram of effects of the rotary body unit according to the comparative example.

The structure of this embodiment also reduces contamination of the charger 130. In the rotary body unit of the comparative example shown in FIG. 5B (where a prime "'" symbol has been added to the reference numerals for the photosensitive drum and cleaning roller to distinguish them from the components in the rotary body unit of this embodiment), the circumferential speed of the cleaning roller 150' is faster than that of the photosensitive drum 120'. Consequently, toner and the like is expelled toward the charger 130 from between the photosensitive drum 120' and cleaning roller 150', causing toner and the like to become deposited on and to contaminate the charger 130.

In this embodiment shown in FIG. 5A, on the other hand, the circumferential speed of the cleaning roller 150 is slower than that of the photosensitive drum 120, reducing the likelihood of toner and the like being expelled toward the charger 130 from between the photosensitive drum 120 and cleaning roller 150. Accordingly, this construction can reduce contamination of the charger 130.

While the invention has been described in detail with reference to specific embodiments thereof, it would be apparent to those skilled in the art that many modifications and variations may be made therein without departing from the spirit of the invention, the scope of which is defined by the attached claims.

In the embodiment described above, the cleaning roller 150 rotates along with the photosensitive drum 120 due to the friction generated between the outer peripheral surface 121 of the photosensitive drum 120 and outer peripheral surface 151 of the cleaning roller 150, but the embodiment is not limited to this configuration. In the example shown in FIG. 6, a cleaning roller 251 has a roller body 251A that abuts the outer peripheral surface 121 of the photosensitive drum 120. The roller body 251A is formed of an elastic foam material. Here, the cleaning roller 251 may be formed with an outer peripheral surface having a low coefficient of friction so that the cleaning roller 251 cannot easily follow the rotation of the photosensitive drum 120 from the friction generated by the outer peripheral surface 121 of the photosensitive drum 120.

In this case, friction wheels 252 may be provided on both axial ends of the cleaning roller 251 as another example of the second rotary body. The friction wheels 252 have a larger coefficient of friction than the outer peripheral surface of the roller body 251A and are configured to rotate together with the cleaning roller 251.

The outer peripheral surfaces (reference numbers have not been provided in the drawing) of the friction wheels 252 contact the outer peripheral surface 121 of the photosensitive drum 120 so that both the friction wheels 252 and the cleaning roller 251 follow the rotation of the photosensitive drum 120 through the friction generated between the outer peripheral surface 121 of the rotating photosensitive drum 120 and the outer peripheral surfaces of the friction wheels 252. As the roller body 251A rotates, its outer peripheral surface slides against the outer peripheral surface 121 of the photosensitive drum 120, recovering toner and the like that has been deposited on the outer peripheral surface 121.

Figure 6:
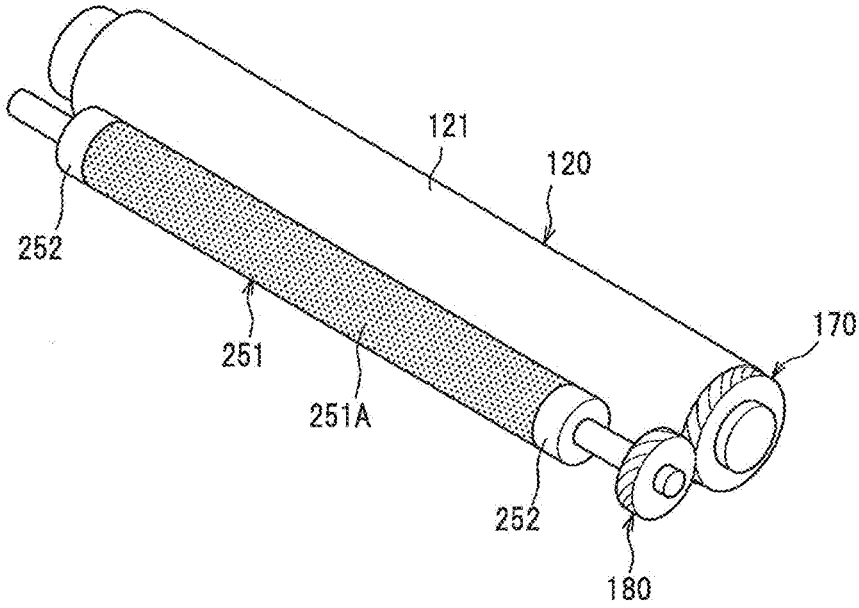
FIG. 6 is a perspective view of a rotary body unit according to a modification to the embodiment.

In the variation shown in FIG. 6, one friction wheel 252 is provided on each axial end of the cleaning roller 251, but two or more friction wheels 252 may be provided on each axial end.

In the above embodiment, the cleaning roller 150 is used as an example of the member (cleaning member) that recovers toner and the like deposited on the outer peripheral surface 121 of the photosensitive drum 120 by sliding against the outer peripheral surface 121, but the embodiment is not limited to this configuration. In the example shown in FIG. 7, the cleaning member is a cleaning brush 350. The cleaning brush 350 has a core part 351 that rotates together with at least one friction wheel (not shown, a second rotary body) provided on each axial end thereof, and bristles 352 extending radially outward from the core part 351. The bristles 352 serve as the cleaning part of the cleaning brush 350 and are more flexible than the outer peripheral surfaces of the friction wheels.

Figure 7:
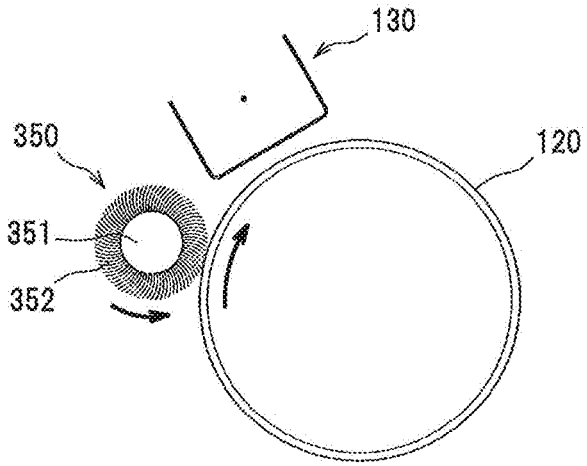
FIG. 7 is an explanatory diagram of a rotary body unit according to another modification to the embodiment.

As described above, the present invention can be applied to a rotary body unit equipped with the cleaning roller 251, as shown in FIG. 6, whose roller body 251A has an outer peripheral surface with a low coefficient of friction; and a rotary body unit equipped with the cleaning brush 350 or the like having the flexible bristles 352, as shown in FIG. 7. All of these configurations reduce fluctuation in the circumferential speed of the photosensitive drum 120 and thereby reduce banding.

In the variation of FIG. 7 (or FIG. 6), the charger 130 is preferably disposed adjacent to the cleaning brush 350 (or cleaning roller 251) on the downstream side of the cleaning brush 350 (or cleaning roller 251) with respect to the rotating direction of the photosensitive drum 120. This configuration suppresses the expelling of toner and the like toward the charger 130 between the photosensitive drum 120 and cleaning brush 350 (or cleaning roller 251) by configuring the circumferential speed of the cleaning brush 350 (or cleaning roller 251) to be slower than that of the photosensitive drum 120, thereby reducing contamination of the charger 130.

While the entire roller body of the cleaning roller 150 is formed of an elastic foam material in the above embodiment, the present invention is not limited to this structure. However, at least a layer of elastic foam should be provided on the outer peripheral surface of the cleaning roller. In other words, it is sufficient that only the surface layer of the roller body is formed of an elastic foam material. Alternatively, the roller body of the cleaning roller may be formed of rubber or the like.

While the scorotron charger 130 is used as an example of charging means in the above embodiment, the present invention may be applied to a device employing a corotron charger, a pin array charger, or a charge roller, for example.

In the embodiment described above, the color printer 1 for forming color images is described as the image-forming device that employs the rotary body unit of the present invention, but the present invention may also be applied to printers that form only monochrome images. The image-forming device is also not limited to printers, but may be a photocopier or multifunction peripheral that includes a flatbed scanner or other original reading device, for example.

In the above description, the photosensitive drum 120 is used as an example of the first rotary body, while the cleaning roller 150 and friction wheels 252 are used as the second rotary body, but the present invention is not limited to these configurations. For example, when the first rotary body is a photosensitive drum, the second rotary body may be a developing roller, charge roller, or the like.

Experiment

Next, an experiment for confirming the effects of the embodiment (reduced contamination of the chargers) will be described. In this experiment, image formation (solid printing at a constant density) was performed on paper using both a printer of the embodiment described above and a printer of a comparative example to confirm whether errors or the like occurred due to contamination of the chargers (and specifically the corona wires and grids in the chargers).

The printer of the experiment has the same structure as the printer described in the embodiment described above, which is provided with the rotary body unit of the present invention. In this rotary body unit, the cleaning roller follows the rotation of the photosensitive drum by friction generated therebetween. The circumferential speed of the cleaning roller is slower than that of the photosensitive drum, with the ratio of circumferential speeds (speed of the cleaning roller÷speed of the photosensitive drum) being 0.8.

The printer of the comparative example, on the other hand, has a similar structure to the conventional technology shown in FIG. 4A. That is, the cleaning roller follows the rotation of the photosensitive drum through a drive force transmitted from the first gear to the second gear. In this printer, the circumferential speed of the cleaning roller is faster than that of the photosensitive drum, with the ratio of circumferential speeds being 1.3.

The results of the experiments are indicated in Tables 1 and 2 below and FIGS. 8A, 8B, 9A, AND 9B. Table 1 and FIGS. 8A and 8B show results of an experiment to confirm the effects and appearance of contamination on the corona wire, and Table 2 and FIGS. 9A and 9B show results of an experiment to confirm the effects and appearance of contamination on the grid.

TABLE 1

| | Number of Discharge Error (while printing 15,000 sheets) |
|---|---|
| Embodiment (Speed Ratio: 0.8) | 0 |
| Comparative Example (Speed Ratio: 1.3) | 4 |

Figure 8A:
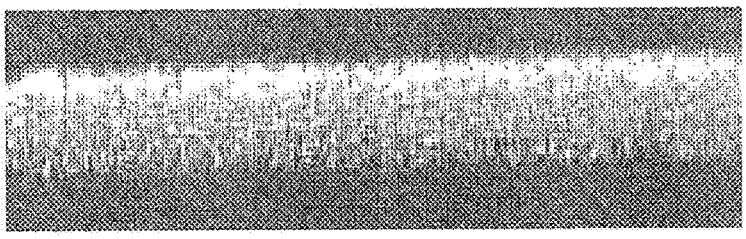
FIG. 8A is a photo showing a result of an experiment to confirm effects and appearance of contamination on a corona wire according to the embodiment.
Figure 8B:
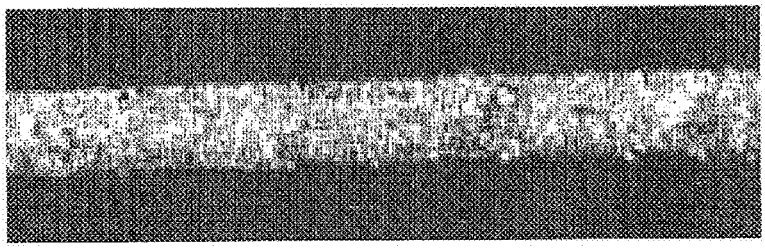
FIG. 8B is a photo showing a result of an experiment to confirm effects and appearance of contamination on a corona wire according to the comparative example.
Figure 9A:
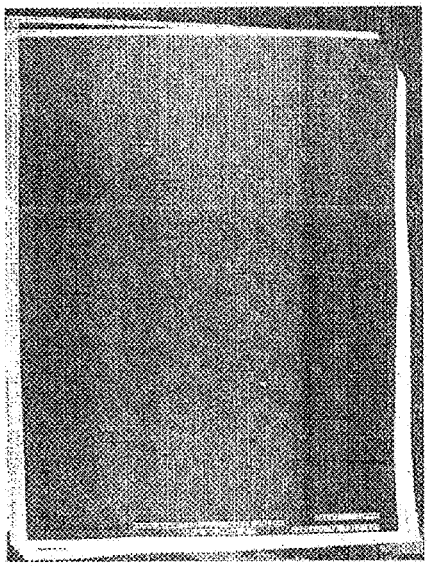
FIG. 9A is a photo showing a result of an experiment to confirm effects of contamination of a grid on printing according to the embodiment.
Figure 9B:
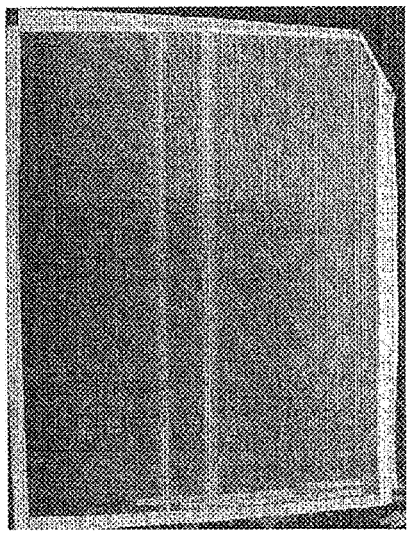
FIG. 9B is a photo showing a result of an experiment to confirm effects of contamination of a grid on printing according to the comparative example.

The photos of FIGS. 8A and 8B illustrate the effects of contamination on the corona wire (total length: 250 min) from one end to a position 120 mm from the end for both the embodiment described above and the comparative example after printing 2,400 sheets. While the corona wire in the comparative example of FIG. 8B is considerably black from deposited contaminants, the corona wire in the embodiment described above shown in FIG. 8A has very little deposited contaminants.

As indicated in Table 1 above, a discharge error occurred four times while printing 15,000 sheets in the comparative example, while no discharge errors occurred in the embodiment described above. A discharge error in this case is an error in corona discharge caused by contamination of the corona wire. In this experiment, discharge errors were confirmed based on the wave form of the grid current.

Based on these results, it is clear that the corona wire in the embodiment described above suffers from very little contamination, even after repeated printing operations.

TABLE 2

| | Printing Problems (while printing 15,000 sheets) | Average Increased Thickness of Grid (μm) |
|---|---|---|
| Embodiment (Speed Ratio: 0.8) | Did not occur | 26 |
| Comparative Example (Speed Ratio: 1.3) | Occurred at 2,000 sheets | 65 |

The photos in FIGS. 9A and 9B illustrate the effects of contamination on the grid in samples (sheets of paper) printed by the printer of the embodiment described above and the printer of the comparative example after 15,000 sheets were printed. In the comparative example shown in FIG. 9B, two white lines extending vertically on the paper can be seen in the photo, but no vertical white lines appear in the sample of the embodiment described above shown in FIG. 9A. The white lines in the comparative example are likely due to irregular charging caused by contamination of the grid.

As is clear from Table 2 above, the white lines described above (printing problems) begin to occur after 2,000 sheets have been printed in the comparative example, but no such printing problems occurred in the embodiment described above while printing 15,000 sheets. Further, the average increased thickness of the grid in the comparative example was a considerably thick 65 μm, while the average increased thickness of the grid in the embodiment described above plateaued at 26 μm.

Based on these results, it is clear that contamination of the grid in the embodiment described above did not occur to an extent that could cause printing problems, even after numerous printing operations.

Thus, the above working example confirmed that the rotary body unit of the embodiment can reduce contamination of the chargers, i.e., contamination of the corona wires and grids therein, more so than the conventional device.

What is claimed is:

1. A rotary body unit comprising:

a first rotary body configured to rotate about a central axis by a drive force input from an external source and having a first outer peripheral surface, the first rotary body having a radius that is a distance from the central axis of the first rotary body to the first outer peripheral surface;

a second rotary body having a second outer peripheral surface contacting the first outer peripheral surface of the first rotary body, a friction being generated between the first outer peripheral surface and the second outer peripheral surface when the first rotary body rotates, the second rotary body being configured to rotate about a central axis of the second rotary body by following a rotation of the first rotary body through the friction, the second rotary body having a radius that is a distance from the central axis of the second rotary body to the second outer peripheral surface;

a first gear configured to rotate together with the first rotary body; and a second gear configured to rotate together with the second rotary body and directly, meshingly engaged with the first gear, the first gear having a first pitch circle defined by meshing engagement with the second gear, the second gear having a second pitch circle defined by the meshing engagement with the first gear, wherein a radius of the first pitch circle is smaller than the radius of the first rotary body, and a radius of the second pitch circle is larger than the radius of the second rotary body.

2. The rotary body unit according to claim 1, wherein, each of the first gear and the second gear is a helical gear.

3. The rotary body unit according to claim 1, wherein the first rotary body is a photosensitive drum for carrying a developer image on the first outer peripheral surface, and wherein the second rotary body is a cleaning roller that is configured to remove matter from the first outer peripheral surface of the photosensitive drum.

4. The rotary body unit according to claim 3, wherein the cleaning roller comprises an elastic foam layer constituting the second outer peripheral surface.

5. The rotary body unit according to claim 3, further comprising a charging unit configured to charge the first outer peripheral surface of the photosensitive drum, wherein the charging unit is disposed adjacent to the cleaning roller on a downstream side of the cleaning roller in a direction that the photosensitive drum rotates.

6. The rotary body unit according to claim 1, further comprising a cleaning member configured to rotate together with the second rotary body, configured to slide against the first outer peripheral surface to remove matter from the first outer peripheral surface of the first rotary body, and including a cleaning part that is more flexible than the second outer peripheral surface of the second rotary body, the cleaning member having axial ends, wherein the first rotary body is a photosensitive drum for carrying a developer image on the first outer peripheral surface, and wherein at least one second rotary body is provided on one axial end of the cleaning member, and another at least one second rotary body is provided on another axial end of the cleaning member.

7. The rotary body unit according to claim 6, further comprising a charging unit configured to charge the first outer peripheral surface of the photosensitive drum, wherein the charging unit is disposed adjacent to the cleaning member on a downstream side of the cleaning member in a direction that the photosensitive drum rotates.

8. The rotary body unit according to claim 1, further comprising a cleaning roller configured to rotate together with the second rotary body, configured to slide against the first outer peripheral surface to recover matter deposited on the first outer peripheral surface of the first rotary body, and including a roller body having a third outer peripheral surface having a friction, coefficient lower than that of the second outer peripheral surface, the cleaning roller having axial ends, wherein the first rotary body is a photosensitive drum for carrying a developer image on the first outer peripheral surface, and wherein at least one second rotary body is provided on one axial end of the cleaning roller, and another at least one second rotary body is provided on another axial end of the cleaning roller.

9. The rotary body unit according to claim 8, wherein the cleaning roller comprises an elastic foam layer constituting the third outer peripheral surface.

10. The rotary body unit according to claim 8, further comprising a charging unit configured to charge the first outer peripheral surface of the photosensitive drum, wherein the charging unit is disposed adjacent to the cleaning roller on a downstream side of the cleaning roller in a direction that the photosensitive drum rotates.

* * * * *